United States Patent [19]

Dick et al.

[11] 3,982,338

[45] Sept. 28, 1976

[54] MATERIAL HANDLING APPARATUS

[75] Inventors: Perry J. Dick; Perry J. Dick, Jr., both of Pittsburgh, Pa.

[73] Assignee: Trumbull Corporation, Pittsburgh, Pa.

[22] Filed: Dec. 16, 1974

[21] Appl. No.: 532,774

[52] U.S. Cl. ..... 37/102; 37/4; 37/110

[51] Int. Cl.[2] ..... E02F 5/00

[58] Field of Search ..... 37/108.8, 126, 129, 37/101, 108, 110, 4; 198/53, 59

[56] References Cited

UNITED STATES PATENTS

| | | | |
|---|---|---|---|
| 1,541,310 | 6/1925 | Anderson | 37/102 |
| 2,618,083 | 11/1952 | Armington | 37/110 |
| 2,855,116 | 10/1958 | Moore | 37/4 UX |
| 3,049,817 | 8/1962 | MacDonald | 37/108 R |
| 3,306,419 | 2/1967 | Palmer et al. | 37/102 X |
| 3,369,310 | 2/1968 | Puckett | 37/101 X |
| 3,744,164 | 7/1973 | Harrison | 37/108 R |
| 3,885,332 | 5/1975 | Holland | 37/102 |

*Primary Examiner*—Stephen C. Pellegrino
*Attorney, Agent, or Firm*—Stanley J. Price, Jr.; John M. Adams

[57] ABSTRACT

A scraper bowl with a bottom wall having a downwardly deflected scraper blade is connected at its rearward end portion to a conveyor support frame having an upper inclined platform that extends rearwardly from the scraper bowl and terminates in a horizontal cantilivered platform. The conveyor support frame is connected to ground traction devices by a leveling mechanism that maintains vertical positioning of the support frame as the scraper bowl is forwardly propelled by a prime mover. An inclined endless belt conveyor is secured to the inclined platform and includes an end portion positioned within the scraper bowl for receiving dislodged material. Oscillating plate members within the scraper bowl assist in transferring the material onto the inclined conveyor. The material is transported rearwardly of the scraper bowl by the inclined conveyor onto an endless belt conveyor that is supported by the horizontal platform and is positioned intermediately to and transversely of the inclined conveyor. Material haulage vehicles are adapted to be positioned in material receiving relationship with the end portions of the transverse conveyor and proceed at the rate of speed of the prime mover to remain in material receiving relationship with the transverse conveyor as the scraper bowl is being loaded. Rotation of the transverse conveyor in a preselected direction discharges the material into one of the haulage vehicles and upon completion of loading thereof, the transverse conveyor is rotated in the opposite direction to load the other haulage vehicle. Thus, the scraper bowl is continuously loaded without interruption during the unloading of the material into the haulage vehicles.

10 Claims, 6 Drawing Figures

MATERIAL HANDLING APPARATUS

BACKGROUND OF THE INVENTION

1. Field of the Invention

This invention relates to a material handling apparatus and more particularly to material handling apparatus that includes a scraper bowl that is connected to a conveyor system that is movable with the scraper bowl to provide continuous loading, transporting and unloading of the material.

2. Description of the Prior Art

Conventional earth moving and excavation machines that include a scraper bowl propelled by a prime mover load material, such as earth, into the scraper bowl as the prime mover advances the scraper blade in contact with the material. Once the scraper bowl is loaded, it must be removed from the loading cycle by transporting the scraper bowl to a location distant from the work site for unloading.

Consequently, the efficiency of the scraper bowl is substantially reduced by removing the scraper bowl from the loading operation as it is being transported and unloaded. Thus, if the earth moving machine is to be operated substantially continuously, it is necessary to maintain the earth moving machine in the loading cycle and avoid intermittent shut-downs of the loading cycle during the transporting and unloading of the earth moving machine.

One device for continuously handling material without interrupting the loading cycle is disclosed in U.S. Pat. No. 1,241,880 wherein a stone gathering device is carried forwardly of a mobile support frame and is adapted to gather up stones on the ground and transfer them onto an inclined endless conveyor that is supported rearwardly of the gathering device on the mobile frame. The discharging end portion of the endless conveyor is elevated in overlying relationship above an inclined transverse conveyor that has a discharging end portion arranged in overlying material receiving relationship with a wagon to be loaded with the gathered stones. With this arrangement, the wagon may travel with the gathering machine to permit continuous gathering of the stones simultaneous with loading the stones into the wagon. One disadvantage of this system is that the gathering and conveying of the material must be terminated during the period in which an unloaded wagon replaces a loaded wagon in material receiving relationship with the transverse conveyor.

In U.S. Pat. No. 3,507,060, a conventional motor scraper is provided with an elevator positioned in the scraper bowl and arranged in material discharging relationship with a side casting conveyor. The earthen material loaded into the scraper bowl is conveyed by the elevator conveyor into the side casting conveyor that includes a hopper for intermittent storage of the earthen material. With this arrangement, the side casting conveyor is adapted to unload the material into a haulage vehicle as the material is loaded in the scraper bowl. During the period of time in which the haulage vehicle is removed from material receiving relationship with the side casting conveyor, the material may be intermittently stored within the hopper of the side casting conveyor. Upon return of the haulage vehicle in material receiving relationship with the side casting conveyor, the conveyor motor thereof is actuated to continue the unloading of the material from the scraper bowl.

A system employing a pivotal discharge conveyor wherein continuous excavation of material by a conventional front end loader is sought to be effected is disclosed in U.S. Pat. No. 3,680,233. In this system, an elevator is mounted to the front end portion of the loader and is adapted to receive material picked up by the scraper blade. The material is transferred from the elevator by an interconnecting conveyor onto a rear mounted swivel conveyor. The rear mounted swivel conveyor is arranged to swing by operation of a hydraulic cylinder about a horizontal axis in vertical arcs. Material is discharged from the swivel conveyor into a conventional hauling vehicle located to either side of the continuous excavating vehicle. The hauling vehicle proceeds at the rate of speed of the continuous excavating vehicle as it is being loaded; however, the loading operation must be interrupted during the exchange of an unloaded hauling vehicle with a loaded hauling vehicle in material receiving relationship with the swivel conveyor.

There is need for an apparatus for the hauling of earthen material which continuously loads and transports the earthen material without interruption during the unloading of the earthen material.

SUMMARY OF THE INVENTION

In accordance with the present invention there is provided material handling apparatus that includes a mobile support frame having ground traction devices. A scraper bowl is secured to and positioned forwardly of the mobile support frame. The scraper bowl has a bottom wall with a downwardly deflected scraper blade that is secured to the forward end portion of the bottom wall. A raising and lowering mechanism is provided on the scraper bowl to move the scraper blade into and out of engagement with the ground. An inclined endless conveyor is secured to the mobile support frame and is positioned thereon parallel to the position of travel of the scraper bowl. The inclined endless conveyor has a lower material receiving end portion that is positioned within the scraper bowl and has an upper material discharging end portion that is positioned rearwardly of the scraper bowl. The material receiving end portion is arranged to receive material from the scraper bowl and to convey the material upwardly and rearwardly to the material discharging end portion. A transverse endless conveyor is secured to the mobile support frame and intermittently positioned beneath the material discharging end portion to convey the material laterally in a selected direction therefrom. A motor rotates the inclined endless conveyor and the transverse endless conveyor to convey the material from the scraper bowl by the inclined endless conveyor to the transverse endless conveyor.

An oscillating mechanism provided within the scraper bowl is operable to continuously move the material loaded into the scraper bowl onto the material receiving end portion of the inclined endless conveyor. The oscillating mechanism includes pairs of pivotally connected vertical plate members that are hinged at one end portion to the scraper bowl sidewalls and movable laterally toward and away from the inclined conveyor. Movement of the plate members is accomplished by piston cylinder assemblies having extensible rods secured to the plate members. The piston cylinder assemblies are actuated sequentially at preselected intervals to oscillate the pairs of plate members in timed relation to each other. In this manner the dislodged material is continuously fed from the scraper bowl onto the inclined conveyor.

The ground traction devices are connected to the mobile support frame by a pair of yoke members each having a pair of spaced arm members that are secured to and extend downwardly from opposed sides of said mobile support frame. The yoke members are provided with a leveling mechanism that maintains the mobile support frame in a substantially vertical position as the material handling apparatus is propelled over rough terrain. Each of the yoke arm members slidably receives a vertical support member. The lower end portion of the support member is secured to the ground traction device and the upper end portion to a piston cylinder assembly mounted on the yoke member. Actuation of the piston cylinder assembly extends and retracts the support member relative to the yoke member to thereby maintain the traction device in ground engaging relationship. The leveling mechanisms for both traction devices are independently operable to adjust the elevation of the traction devices and maintain vertical positioning of the conveyor support frame.

The inclined endless conveyor is a flexible endless belt that is secured to the upper inclined surface of the mobile support frame and includes a lower material receiving end portion and an upper material discharging end portion. As the dislodged material is loaded into the scraper bowl, it is directed by the oscillating plate members of the scraper bowl onto the material receiving end portion of the inclined conveyor. The material is transferred from the material receiving end portion onto the transverse endless conveyor. The transverse endless conveyor is an endless flexible belt that is rotatably driven by suitable hydraulic motors in either a clockwise or counterclockwise direction. With this arrangement, by selectively rotating the transverse endless conveyor, material may be discharged laterally of the inclined endless conveyor at either end portion of the transverse conveyor into a haulage vehicle positioned therebelow. The prime mover can forwardly advance the scraper bowl to load the scraper bowl as material is being discharged into the haulage vehicles which travel at the rate of speed of the prime mover.

Accordingly, the principal object of this invention is to provide a material handling apparatus to continuously convey material loaded into a scraper bowl onto a conveyor system that is secured to the scraper bowl and movable therewith for transfer of the conveyed material into a suitable haulage vehicle.

Another object of the present invention is to provide a scraper bowl that is forwardly advanced by a prime mover to load the scraper bowl and to transfer the material onto an inclined endless conveyor extending rearwardly from and above the scraper bowl to a transverse conveyor that is rotated in a preselected direction to discharge the material onto a haulage vehicle positioned below the transverse endless conveyor.

A further object of the present invention is to provide a material handling apparatus having a scraper bowl that is connected to a mobile conveyor system that is propelled by a prime mover to permit continuous loading of the scraper bowl, transporting of the material and discharging of the material into haulage vehicles as the prime mover forwardly advances the scraper bowl.

A still further object of the present invention is to provide a scraper bowl having oscillating plate members positioned laterally of the inclined endless conveyor and operable to continuously transfer material from the scraper bowl onto the inclined conveyor.

Another object of the present invention is to provide a material handling apparatus having a conveyor support frame that is connected to ground traction devices by a leveling mechanism that maintains the traction device in ground engaging relationship and the conveyor support frame is substantially vertical position as it is propelled over rough terrain.

These and other objects of the present invention will be more completely disclosed and described in the following specification, the accompanying drawings and the appended claims.

DESCRIPTION OF THE PREFERRED EMBODIMENTS

Figure 1:
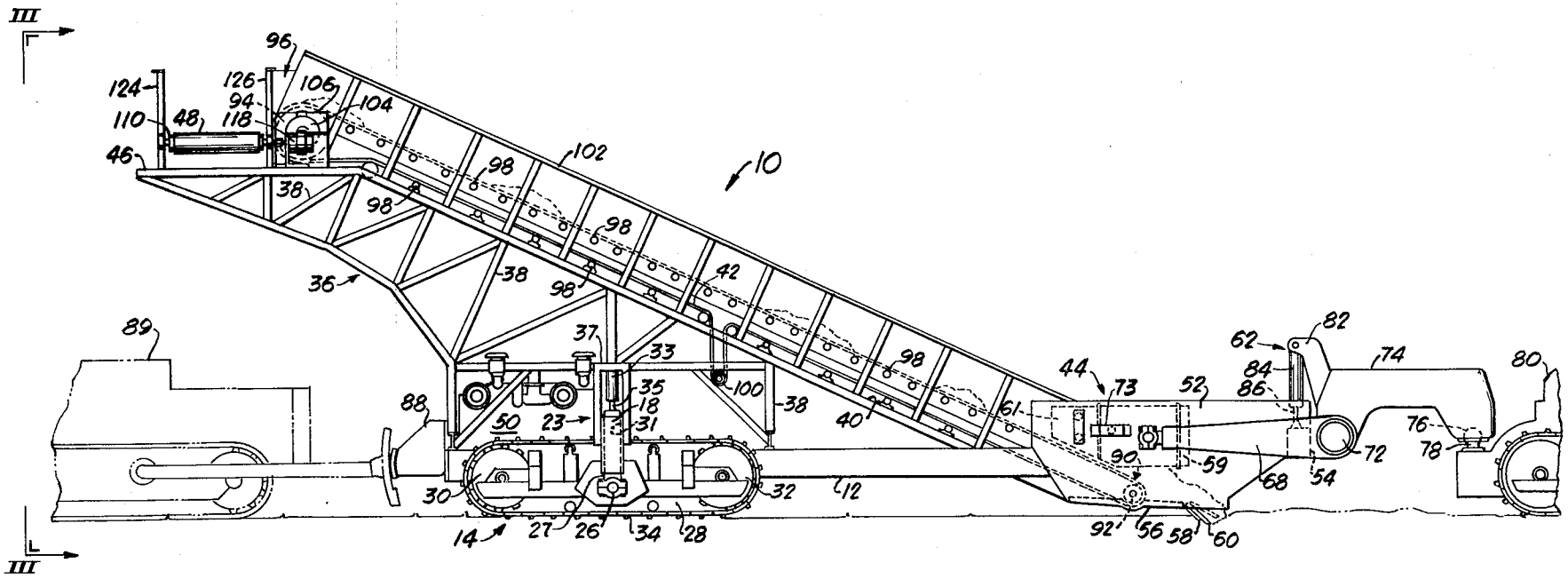
FIG. 1 is a view in plan elevation of the material handling apparatus, schematically illustrating a tractor connected to the forward end portion of the scraper bowl and a bulldozer for propelling the scraper bowl across the surface of the ground to direct material into the scraper bowl for transfer onto the conveyor system.
Figure 2:
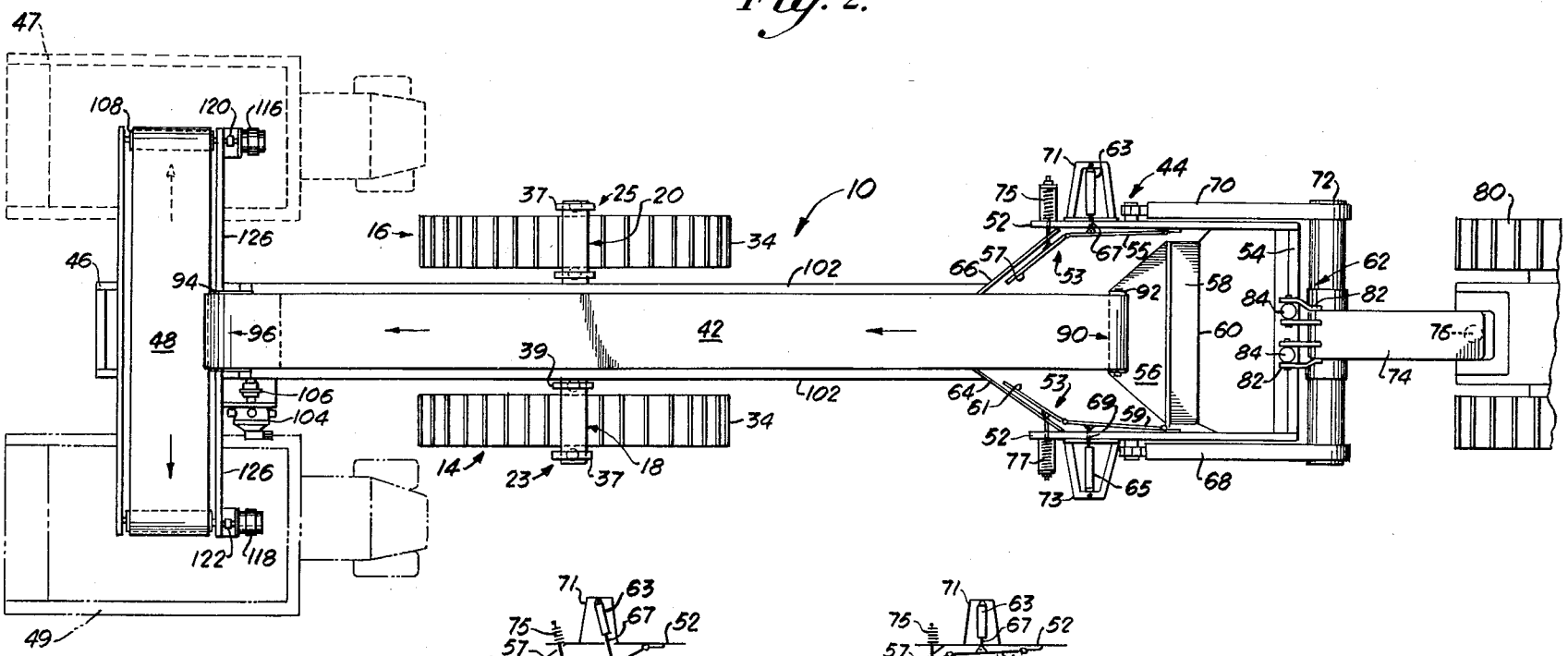
FIG. 2 is a plan view of the material handling apparatus illustrated in FIG. 1, illustrating the relationship of the scraper bowl to the inclined endless conveyor and the transverse endless conveyor.
Figure 3:
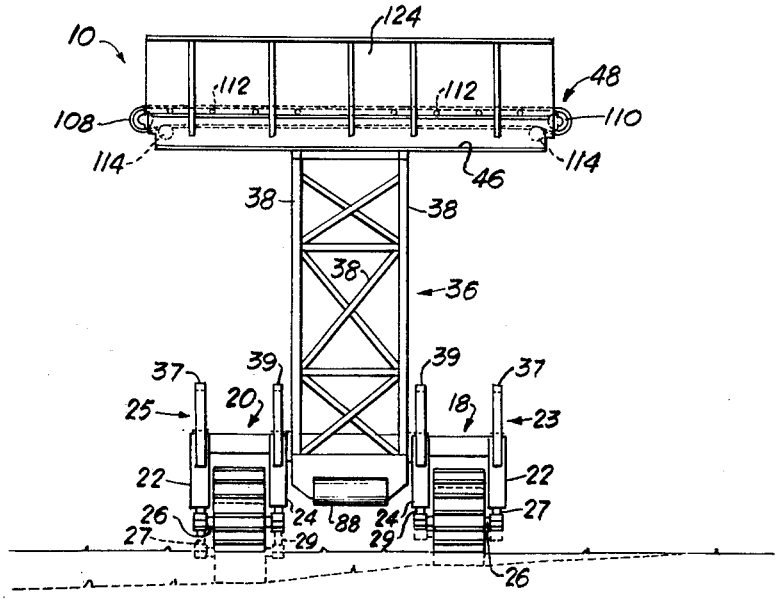
FIG. 3 is a view in end elevation taken along the line III—III of FIG. 1, illustrating the connection of the support frame to the ground engaging tracks that support the material handing apparatus for movement over the ground.

Referring to the drawings, and particularly to FIGS. 1 and 2, there is illustrated a material handling apparatus generally designated by the numeral 10 that includes a main frame 12 that is connected to a pair of propelling devices 14 and 16 by yoke members 18 and 20 (as illustrated in FIG. 3) that project laterally and outwardly from the main frame 12. Each of the yoke members 18 and 20 include a pair of downwardly extending arm members 22 and 24, that are provided with conveyor support leveling mechanisms 23 and 25 hereinafter described in greater detail. The propelling devices 14 and 16 are received between the respective arm members 22 and 24 and are connected thereto by trunnions 26. Each of the propelling devices 14 and 16 include a track frame 28 having a pair of cylinders 30 and 32 rotatably secured to the end portions of the track frame. An endless track 34 is reeved around the cylinders 30 and 32. With this arrangement, the material handling apparatus 10 is propelled under the power of a suitable prime mover, hereinafter described.

A conveyor support frame generally designated by the numeral 36 is mounted on the main frame 12 and extends vertically upwardly therefrom. The conveyor support frame 36 includes a plurality of strut members 38 that form an upper inclined platform 40 for supporting an inclined endless conveyor 42. The lower end portion of the inclined platform 40 is secured to a conventional scraper bowl, generally designated by the numeral 44 that is secured to the forward end portion of the main frame 12. The inclined platform 40 is coaxially positioned with respect to the longitudinal axis of scraper bowl 44 and extends upwardly therefrom on a diagonal to an upper end portion that is elevated above the main frame 12.

The upper end portion of the inclined platform 40 is secured to one end of a horizontal platform 46 that is cantilevered to and extends outwardly from the inclined platform. The horizontal platform 46 supports an endless conveyor 48 transversely relative to the inclined conveyor 42. With this arrangement, the transverse conveyor 48 on the horizontal platform 46 extends outwardly beyond the main frame 12 and is adapted to overlie conventional dump trucks 47 and 49. The dump trucks 47 and 49 are maintained in underlying relationship with the end portions of the transverse conveyor 48 to receive material discharged therefrom.

Referring to FIGS. 1 and 3, the conveyor support frame leveling mechanisms 23 and 25 that are associated with each of the propelling devices 14 and 16 are operable to maintain the mobile conveyor support frame in a substantially vertical position relative to the ground as it is being propelled over rough terrain. Each of the leveling mechanisms 23 and 25 includes a pair of vertical support members 27 and 29 that are slidably positioned within recesses 31 of the yoke arm members 22 and 24. The support members 27 and 29 are rigidly secured at their lower end portions to the track frame 28 by the trunnions 26. Piston cylinder assemblies 33 each having an extensible rod 35 are secured at the upper end portions thereof to brackets 37 and 39 that are rigidly connected to the yoke arm members 22 and 24. The piston rods 35 are connected to the upper end portion of the slidable vertical support members 27 and 29.

Actuation of the piston cylinder assemblies 33 by supplying fluid under pressure thereto extends the piston rods 35 outwardly and downwardly to move the vertical support members 27 and 28 downwardly within the yoke arm member recesses 31. In this manner a downwardly directed force is imparted to the track frame 28 to maintain the endless track thereof in ground engaging relationship.

Each of the piston cylinder assemblies 33 for the leveling mechanisms 23 and 25 are independently operable to permit the propelling devices 14 and 16 to remain in contact with the ground regardless of the variation in elevation between the propelling as illustrated in FIG. 3. Thus, by raising and lowering the vertical support members 27 and 29 the tracks 34 are maintained in contact with the ground and the conveyor support frame 36, in a substantially vertical position. Maintaining vertical positioning of the conveyor support frame 36 assures horizontal positioning of the transverse conveyor 48 and a uniform distribution of the forces exerted upon the conveyor 48 by the material being discharged from either end portion thereof.

A suitable engine 50 is mounted between the propelling devices 14 and 16 on the main frame 12 and is arranged to supply fluid under pressure to the conveyor support frame leveling mechanisms 23 and 25 and the hydraulic drive motors hereinafter described, for the driven components of the inclined conveyor 42 and the transverse conveyor 48.

As illustrated in FIGS. 1 and 2, the scraper bowl 44 includes a pair of spaced vertical sidewalls 52 that are connected at their rearward end portions to the main frame 12. The forward end portion of the bowl 44 is sealed by a front wall 54 that connects to the forward end portions of the sidewalls 52. A bottom wall 56 extends forwardly from the main frame 12 and is connected to the lower end portions of sidewalls 52. The bottom wall 56 includes a downwardly deflected scraper blade 58 that projects forwardly of the bottom wall between the sidewalls 52.

The scraper blade 58 terminates in a cutting edge portion 60 that is arranged to move into and out of earth engaging relationship by a scraper bowl lifting mechanism, generally designated by the numeral 62. With this arrangement, the cutting edge portion 60 dislodges the upper strata of the earth and directs the earthen material over the scraper blade 58 into the bowl 44, as the material handling apparatus 10 is forwardly advanced. Rear walls 64 and 66 are secured to the rearward end portion of the sidewalls 52 and converge inwardly to connect at their outer end portions to the lower end portion of the inclined platform 40. The rear walls 64 and 66 are spaced apart to receive the inclined conveyor 42 and thus seal the rearward end portion of the scraper bowl 44.

Transfer of the material from the scraper bowl 44 onto the receiving end portion of the inclined conveyor 42 is accomplished by operation of an oscillating mechanism generally designated by the numeral 53. The oscillating mechanism 53 includes a first pair of vertical plate members 55 and 57 and a second pair of vertical plate members 59 and 61 positioned laterally of the receiving end portion of the inclined conveyor 42. The plate members 55 and 59 are hingedly connected at their forward end portions to the scraper bowl sidewalls 52. The rearward end portions of the plate members 55 and 59 are hingedly connected to the forward end portions of plate members 57 and 61, respectively. With this arrangement, the plate members 55, 57, 59 and 61 are supported for movement on the bottom wall 56 of the scraper bowl 44.

Movement of the plate members 55, 57, 59 and 61 is accomplished by piston cylinder assemblies 63 and 65 having extensible piston rods 67 and 69, respectively. The piston cylinder assemblies 63 and 65 are mounted outboard of the sidewalls 52 on brackets 71 and 73 secured thereto with the piston rods 67 and 69 extending through the sidewalls 52. The end portions of the piston rods 67 and 69 are rigidly connected to the plate members 55 and 59, respectively.

The plate members 57 and 61 are biased by compression springs 75 and 77 in a position substantially parallel to the scraper bowl rear walls 66 and 64, respectively. One end portion of each of the springs 75 and 77 is immovably secured to the sidewalls 52 with the other end portion of the springs connected to the plate members 57 and 61. With this arrangement, outward extension of the piston rods 67 and 69 upon actuation of the piston cylinder assemblies 63 and 65 pivots the plate members 55 and 59 about their pivotal connections to the sidewalls 52 inwardly toward the inclined conveyor 42.

Pivotal movement of the plate members 55 and 59 urges the plate members 57 and 61 to move from a first position parallel to the rearwalls 66 and 64 to a second position substantially parallel to the inclined conveyor 42. In this fashion, the plate members transfer the material from the bottom wall 56 onto the inclined conveyor 42. Retraction of the piston rods 67 and 69 and the compression forces exerted by the springs 75 and 77 acting against the plate members 57 and 61 urges the plate members to their original positions within the scraper bowl 44.

Figure 2B:
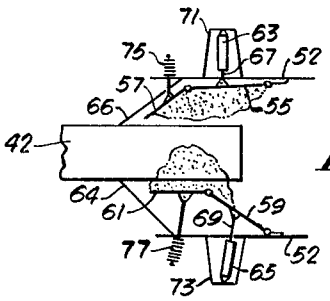
FIGS. 2*a* and 2*b* are schematic fragmentary views of the mechanism for oscillating the hinged plates of the scraper bowl to continuously move the material loaded into the scraper bowl onto the inclined endless conveyor.
Figure 2A:
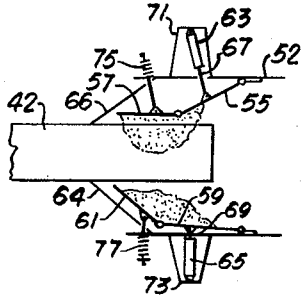

FIGS. 2*a* and 2*b* illustrate the preferred operation of the oscillating mechanism 53. By actuation of the piston cylinder assemblies 63 and 65 sequentially in timed relationship to each other, for example at two-second intervals, the plate member pair 55 and 57 and the plate member pair 59 and 61 oscillate toward and away from the inclined conveyor 42. In this manner, the material loaded within the scraper bowl 44 by the blade 58 is continuously fed from the scraper bowl 44 onto the conveyor 42. Thus, material having a low viscosity does not become clogged within the scraper bowl 44 but remains fluid by the oscillating action of the movable plate members 55, 57, 59 and 61.

The scraper bowl lifting mechanism 62 includes a pair of spaced parallel arm members 68 and 70 that are pivotally connected at one end portion to opposed sides of the scraper bowl sidewalls 52. The arm members 68 and 70 extend forwardly of the scraper bowl 44 and are connected at their other end portions to a bridge bar 72 that is supported transversely and forwardly of the bowl 44 by a goose neck fixture 74. The goose neck fixture 74 has a forward end portion provided with a universal connection 76 that is adapted to receive a hitch pin 78 that is mounted to the rearward end portion of the prime mover 80. With this arrangement, the prime mover 80, such as a conventional tractor or bulldozer, propels the material handling apparatus 10 to load the scraper bowl 44 with earthen material dislodged by the scraper blade 58 as it cuts into the upper strata of the earth.

Extending upwardly and to the rear of the goose neck fixture 74 is a bracket 82. Hydraulic cylinders 84 having extensible pistons 86 are secured opposite one another to the bracket 82. The extensible pistons 86 are secured at their end portions to the front wall 54. Operation of the hydraulic cylinders 84 to extend and retract the pistons 86 pivot the scraper bowl 44 about the arm members 68 and 70 to move the scraper blade 58 into and out of contact with the earthen material to be dislodged or any other material to be deposited into the scraper bowl 44. In accordance with the present invention as illustrated in FIG. 2, the goose neck connection 74 and the elevating conveyor 42 are coaxially aligned with the longitudinal axis of the scraper bowl 44.

A push block 88 is mounted to the rearward end portion of the main frame 12 and is also coaxially aligned with the longitudinal axis of the scraper bowl 44. The application of the forward force to the push block 88 by the blade of a conventional bulldozer 89 forwardly propels the material handling apparatus 10. Thus, the propelling forces exerted at both end portions of the material handling apparatus 10 are directed on a line of action that extends through the center of the scraper bowl 44. With this arrangement, the scraper blade 58 exerts forces of equal magnitude along its entire length upon the upper strata of earth to be dislodged and loaded into the scraper bucket 44. The uniform distribution of forces generated by the scraper blade 58 upon the upper earth strata provides for maximum loading of the scraper bowl 44 and eliminates torque applied to the scraper blade 58.

As the prime mover 80 and bulldozer 89 forwardly propel the scraper bowl 44, the scraper blade 58 dislodges earthen material which travels over the advancing blade and is loaded into the bowl 44. The material that is collected within the scraper bowl 44 is continuously transferred onto the inclined conveyor 42 by operation of the oscillating mechanism 53. The inclined conveyor 42 is an endless flexible belt having a receiving end portion 90 reeved around a cylindrical pulley 92 that is rotatably mounted on the inclined platform 40 within the scraper bowl 44.

The inclined conveyor 42 has an upper end portion reeved around the cylindrical pulley 94 to form a discharging end portion 96. The upper and lower flights of the elevating conveyor 42 are supported by rollers 98 that are rotatably supported on the inclined platform 40 of the conveyor support frame 36. The lower flight of the conveyor 42 extends around a take-up roller 100 that is vertically adjustable to generate a preselected tension in the endless conveyor belt.

A plurality of interconnected vertical plate members 102 are secured to the inclined platform 40 at opposed sides of the inclined conveyor 42 extending from the receiving end portion 90 to the discharging end portion 96. With this arrangement, the earthen material is confined to the inclined conveyor 42 as it is conveyed from the receiving end portion 90 to the discharging end portion 96. The inclined conveyor 42 is rotated in a counterclockwise direction by a hydraulic motor 104 that is connected to the cylindrical pulley 94 through a suitable gear reducer 106. Fluid under pressure is supplied by the engine 50 through conduits (not shown) to the hydraulic motor 104 to drive the motor 104 at a preselected speed and rotate the conveyor 42 over the support rollers 98 and around the take-up roller 100.

Figure 4:
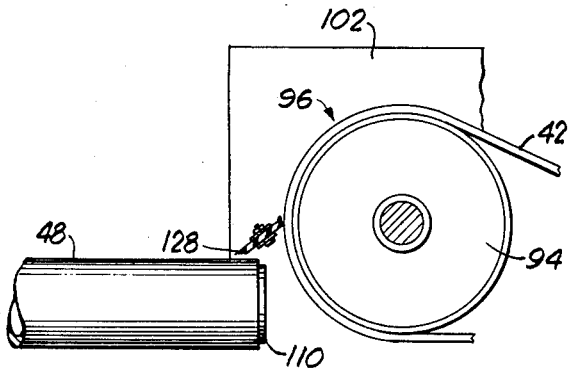
FIG. 4 is a schematic illustration of the connection between the material discharging end portion of the elevating conveyor and the elevated conveyor.

The discharge end portion 96 of the inclined conveyor 42 is positioned above the transverse conveyor 48, as illustrated in FIGS. 1, 2 and 4. The transverse conveyor 48 is a flexible endless belt that is rotatably supported at its end portions by cylindrical rollers 108 and 110 that are rotatably supported on the horizontal platform 46. The endless belt conveyor 48 is positioned intermediate of the inclined conveyor discharging end portion 96 and extends transversely relative to the direction of rotation of the conveyor 42.

The transverse conveyor 48 rotates over support rollers 112 and 114 as illustrated in FIG. 3, and is driven in a preselected direction by hydraulic motors 116 and 118 that are drivingly connected to rollers 108 and 110 through gear reducers 120 and 122 respectively. The engine 50 supplies fluid under pressure through conduits (not shown) to the hydraulic motors 116 and 118 to selectively drive the motors and rotate the endless belt around the rollers 108 and 110 and over the support rollers 112 and 114. With this arrangement, by supplying hydraulic fluid under pressure to a selected one of the motors 116 and 118, the transverse conveyor 48 may be rotated in either a clockwise or a counterclockwise direction for discharging material received from the inclined conveyor 42 to either side of the transverse conveyor 48 into dump trucks 47 and 49 positioned therebelow.

Vertical plate members 124 and 126 are secured to the horizontal platform 46 of the rear support frame 36 at opposed sides of the transverse conveyor 48. The plate member 126 has an opening to receive the discharging end portion 96 of the inclined conveyor 42. As illustrated in FIG. 4, a flexible longitudinal member 128 extends between and is secured to the opening in the vertical plate members 126. The flexible member is tangentially positioned relative to the flexible belt of the inclined conveyor 42 at one end portion and overlies the endless belt of the transverse conveyor 48. Thus, the flexible member 128 directs earthen material discharged from the discharging end portion 96 of the inclined conveyor 42 onto the intermediate portion of the transverse conveyor 48.

The material conveyed from the inclined conveyor 42 to the transverse conveyor 48 may be discharged to either end of the conveyor 48 by actuating either one of the hydraulic motors 116 or 118. With this arrangement suitable haulage vehicles, such as dump trucks 47 and 49, may be positioned adjacent the propelling devices 14 and 16 underlying the end portions of the transverse conveyor 48. Material may then be selectively directed to either end of the transverse conveyor 48 to fill the haulage vehicles positioned therebelow with the earthen material being conveyed.

The discharging of the earthen material from the transverse conveyor 48 may take place as the material handling apparatus 10 is forwardly propelled. The haulage vehicles 47 and 49 travelling at the speed of the prime mover 80 remain beneath the end portions of the transverse conveyor 48 in material receiving relationship therewith. Thus, in accordance with the practice of the present invention, with the haulage vehicle 49 positioned adjacent the propelling device 14 and beneath the transverse conveyor 48, the hydraulic motor 118 may be actuated to rotate the endless belt of the conveyor 48 in a clockwise direction. In this manner, the material from the inclined conveyor 42 is discharged into the haulage vehicle 49 as the material is loaded into the scraper bowl 44.

Upon completion of filling the haulage vehicle 49 adjacent the propelling device 14, the second haulage vehicle 47 positioned adjacent the propelling device 16 receives material from the transverse conveyor 48. By actuating the hydraulic motor 116 the endless belt of conveyor 48 rotates in a counterclockwise direction. In this manner, continuous unloading of the earthen material from the transverse conveyor 48 takes place without interrupting the loading of the earthen material into the scraper bowl 44. Thus, the operations of unloading the material into the scraper bowl 44, conveying the material by the conveyors 42 and 48 and discharging the material from the conveyor 48 takes place continuously without interrupting the forward advancement of the material handling apparatus 10.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. Material handling apparatus comprising, a mobile support frame having ground traction means, a scraper bowl secured to and positioned forwardly of said mobile support frame, said scraper bowl having a bottom wall with a downwardly deflected scraper blade secured to the forward end portion of said bottom wall and inwardly converging sidewalls, means for raising and lowering said scraper bowl to move said scraper blade into and out of engagement with the ground, an inclined endless conveyor secured to said mobile support frame and positioned thereon parallel to the direction of travel of said scraper bowl, said inclined endless conveyor having a lower material receiving end portion positioned between said inwardly converging sidewalls and an upper material discharging end portion positioned rearwardly of said scraper bowl, material moving means secured to said sidewalls for continuously moving the material loaded into said scraper bowl onto said material receiving end portion of said inclined endless conveyor and thereby convey the material upwardly and rearwardly to said material receiving end portion, a transverse endless conveyor secured to said mobile support frame and intermediately positioned beneath said material discharging end portion to convey the material laterally in a selected direction, and drive means for rotating said inclined endless conveyor and said transverse endless conveyor to convey the material from said scraper bowl by said inclined endless conveyor to said transverse endless conveyor.

2. Material handling apparatus as set forth in claim 1 which includes, vertical plate members secured to said support frame at opposed sides of said inclined endless conveyor and arranged to confine on said inclined endless conveyor the material being conveyed from said receiving end portion to said discharge end portion, said transverse endless conveyor having vertical plate members secured to opposed sides thereof and arranged to confine on said transverse endless conveyor the material received from said inclined endless conveyor.

3. Material handling apparatus as set forth in claim 1 in which said material moving means includes, a pair of plate members positioned laterally of said inclined endless conveyor lower receiving end portion within said scraper bowl, piston cylinder means mounted to said sidewalls and having extensible rods connected at one end portion to said plate members, said piston cylinder means operable upon actuation to extend and retract said rods to oscillate said plate members in timed relation toward and away said inclined endless conveyor and thereby continuously move material from said scraper bowl onto said inclined endless conveyor.

4. Material handling apparatus as set forth in claim 3 which includes, said pair of plate members each having a first portion hinged to said sidewalls and a second portion hinged to said first portion at the adjacent end portions of said first and second portions, and resilient means secured at one end to said sidewalls and at the other end to said plate member second portions for urging said plate member second portions together with said plate member first portions away from said inclined endless conveyor.

5. Material handling apparatus as set forth in claim 1 in which said transverse endless conveyor includes, a pair of rollers rotatably supporting the end portions of said transverse endless conveyor, and means drivingly connected to each of said rollers for rotating said transverse endless conveyor in either a clockwise or counterclockwise direction and thereby convey the material from a selected one of the end portions of said transverse endless conveyor.

6. Material handling apparatus as set forth in claim 5 which includes, said means for rotating said transverse endless conveyor being selectively operable to rotate one of said rollers in a clockwise direction to discharge material from one end portion of said transverse endless conveyor and to rotate the other of said rollers in a counterclockwise direction to discharge material from the other end of said transverse endless conveyor.

7. Material handling apparatus as set forth in claim 1 which includes, means for connecting said ground traction means to said mobile support frame, and said ground traction means having means for maintaining said mobile support frame in a vertical position with said ground tractions means remaining in contact with the ground.

8. Material handling apparatus as set forth in claim 7 which includes, said ground traction means including a pair of track frames each rotatably supporting a cylinder at the end portions thereof, an endless track reeved around each of said cylinders, said connecting means including a pair of yoke members each having a pair of spaced arm members secured to and extending outwardly from opposed sides of said mobile support frame.

9. Material handling apparatus as set forth in claim 8 in which said means for maintaining said mobile support frame in a vertical position includes, vertical support members slidably positioned within said yoke member arm members, said vertical support members rigidly secured at one end portion of said track frames, and piston cylinder means secured at one end portion to said yoke members and having extensible rods secured to said vertical support members, said piston cylinder means operable upon actuation to extend and retract said rods to maintain said endless tracks in ground engaging relationship and said mobile support frame in a substantially vertical position.

10. Material handling apparatus as set forth in claim 1 in which said means for raising and lowering said scraper bowl includes, a pair of spaced parallel arm members pivotally connected at one end portion to opposed sides of said scraper bowl, a bridge member having end portions secured to opposite end portions of said arm members, said bridge member having a universal means for engaging a conventional prime mover adapted to propel said material handling apparatus, and piston cylinder means connected at one end portion to said bridge member and at the other end portion to said scraper bowl for pivoting said scraper bowl relative to said arm members to move said scraper blade into and out of contact with the earth to be dislodged thereby.

* * * * *